United States Patent [19]

Simpson

[11] 4,346,769

[45] Aug. 31, 1982

[54] PERCUSSIVE TOOL DRIVE LINKAGE

[75] Inventor: Frank F. Simpson, Staines, England

[73] Assignee: Black & Decker Inc., Newark, Del.

[21] Appl. No.: 102,687

[22] Filed: Dec. 12, 1979

[30] Foreign Application Priority Data

Dec. 12, 1978 [GB] United Kingdom ..... 48306/78

[51] Int. Cl.[3] ..... B25D 11/12

[52] U.S. Cl. ..... 173/118; 173/100; 74/49

[58] Field of Search ..... 173/122, 109, 118, 114, 173/100, 124; 74/49

[56] References Cited

U.S. PATENT DOCUMENTS

| | | | |
|---|---|---|---|
| 1,327,817 | 1/1920 | Gerhard . | |
| 3,642,077 | 2/1972 | Bayard | 173/122 X |
| 3,788,403 | 1/1974 | Mitchell | 74/50 X |
| 3,945,120 | 3/1976 | Ritz | 74/50 |

FOREIGN PATENT DOCUMENTS

| | | |
|---|---|---|
| 1628045 | 1/1974 | Fed. Rep. of Germany . |
| 2702195 | 7/1978 | Fed. Rep. of Germany . |
| 2072259 | 9/1971 | France . |
| 2230467 | 12/1974 | France . |
| 1206853 | 9/1970 | United Kingdom . |

*Primary Examiner*—Werner H. Schroeder
*Assistant Examiner*—Andrew M. Falik
*Attorney, Agent, or Firm*—Walter Ottesen; Edward D. Murphy; Harold Weinstein

[57] ABSTRACT

A percussive tool has a percussion mechanism driven by a linkage that combines the simplicity of a connecting rod drive with the compactness of more complex drives. A first member, which may be a crank, drives a second member, which may be a cylinder, mounted for sliding and pivotal movement in a guide. A piston is mounted for reciprocating movement in the cylinder. Rotation of the crank reciprocates the piston causing blows to be imparted to a tool piece. The tool piece is rotated as well as being subjected to percussion.

15 Claims, 2 Drawing Figures

PERCUSSIVE TOOL DRIVE LINKAGE

This invention relates to percussive tools.

In a known form of percussive tool, percussion is applied to a tool piece either by a piston reciprocated via an air cushion by a cylinder in which it is mounted or by a cylinder reciprocated via an air cushion by a piston which is mounted in the cylinder. In an example of the former case a first member consisting of a crank is mounted for rotation about a first axis and connected to drive means such as an electric motor operative to rotate the crank about the first axis, a second member consisting of a connecting rod is rotatably connected at one end to an eccentric pin of the crank and at the other end is connected to a third member comprising a cylinder which is mounted for linear reciprocating movement and in which is mounted a piston. During percussive operation of the tool the crank drives the connecting rod which in turn reciprocates the cylinder and thereby causes blows to be transmitted to a tool piece.

One disadvantage of a percussion mechanism of this kind is that it is not very compact: the connecting rod is attached to the rear end of the driving member and the crank drive must in turn be connected to the rear end of the connecting rod; consequently a percussion mechanism of this kind is comparatively long.

In one proposal to overcome this difficulty the connecting rod is removed and the crank pin is located in a guide on the rear end of the cylinder, the guide extending transverse to the path of reciprocation. This arrangement disposes of the connecting rod and therefore reduces the length of the mechanism but, in order to prevent excessive wear between the crank pin and the guide relative to which the crank pin both rotates and slides, a somewhat expensive coupling must be provided.

It is an object of the invention to provide a percussive tool with an improved percussion mechanism.

According to the invention there is provided a percussive tool including a first member mounted for rotation about a first axis and connected to drive means operative to rotate the first member about the first axis, a second member rotatably connected to the first member at a position spaced from the first axis and arranged to reciprocate a third member, the arrangement being such that during percussive operation of the tool the first member drives the second member which in turn reciprocates the third member and thereby causes blows to be transmitted to a tool piece, characterized in that the second member is mounted for pivoting movement about a second stationary axis and for sliding movement towards and away from the second axis, and the reciprocating movement of the third member is reciprocating movement relative to the second member.

A percussive tool of this type employs the simple couplings of a percussion mechanism using a connecting rod drive but offers a much more compact arrangement.

The second member may be slidably mounted in or on a fourth member the fourth member being mounted for pivotal movement about the second axis. This is a convenient way of mounting the second member for its pivoting and sliding movement.

The first member may be a crank and may have an eccentric pin on which the second member is rotatably mounted.

The second and third members may be a piston and cylinder. Comparing this arrangement with the known connecting rod drive described above it can be seen that the two members comprising a connecting rod and piston or cylinder connected thereto in the known drive are replaced in this embodiment of the invention by one member comprising a piston or cylinder. This enables the percussion mechanism to be much more compact.

Preferably, the second member is a cylinder and the third member is a piston but it is also possible for the second member to be a piston and the third member to be a cylinder.

Taking the case where the second member is a cylinder and the third member is a piston reciprocation of the piston upon movement of the cylinder towards and away from the second axis may be produced by an air cushion developed between the piston and cylinder.

The first and second axes may be parallel. An arrangement of this kind provides a simple and effective linkage for converting the rotary motion of the first member into sliding and pivoting movement of the second member.

The first and second axes and the longitudinal axis of the tool piece may lie in a common plane. With this arrangement the second member is at one end of its path of movement at the time that it is aligned with the axis of the tool piece and the third member is reciprocating fast relative to the second member. In a normal construction however the maximum speed of the third member is reached just after the second member reaches the end of its path of movement and accordingly it may be preferable to arrange for the second member to be aligned with the axis of the tool piece just after it is at the end of its path of movement. In order to provide this, the longitudinal axis of the tool piece is at a slight angle to the plane of the first and second axes.

The tool may be a percussive drill, rotary motion being imparted to the drill bit in addition to percussive blows.

By way of example an illustrative embodiment of the invention will now be described with reference to the accompanying drawings of which:

Figure 1:
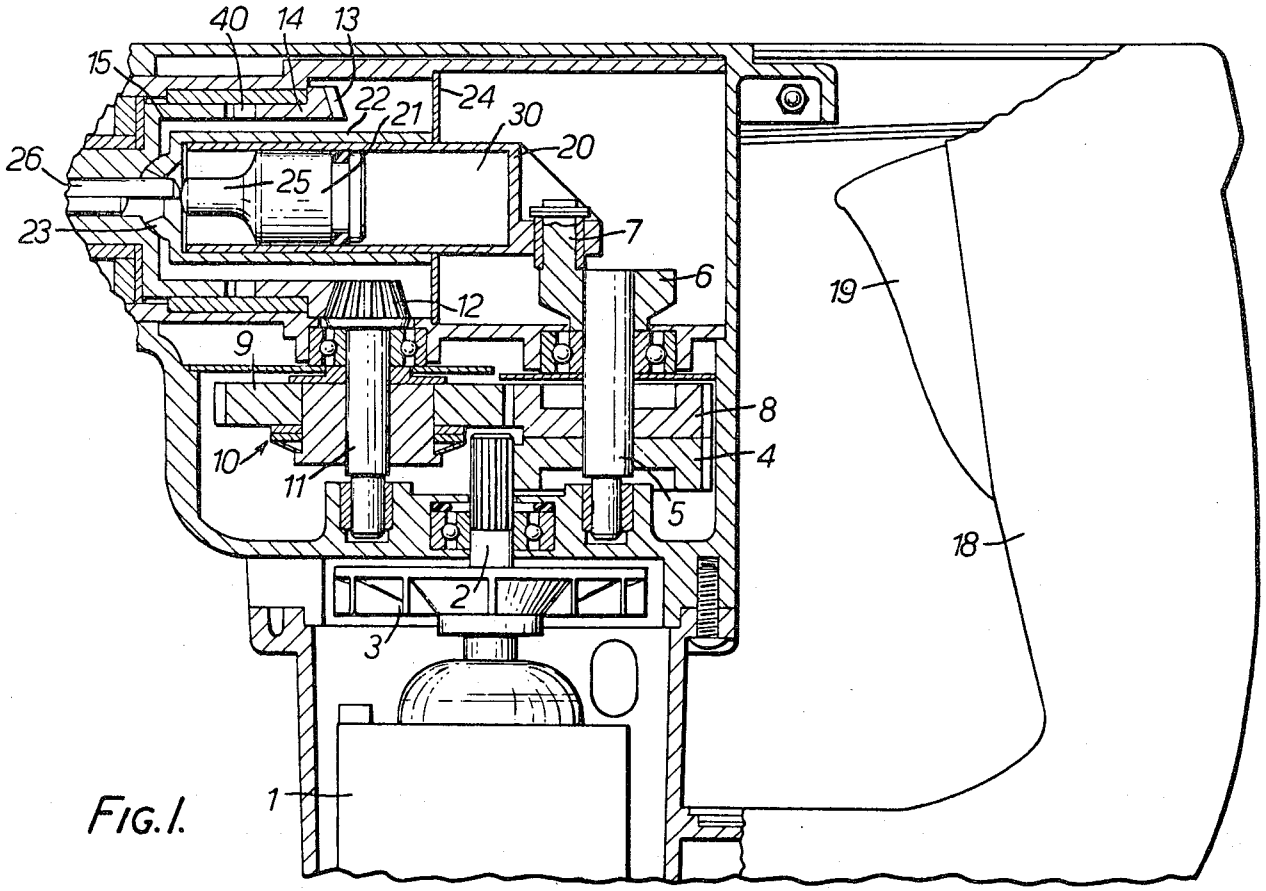
FIG. 1 is a sectional side view of a rotary percussive drill.

Referring first to FIG. 1, in which the lowermost portion of the drill is not shown, the rotary percussive drill includes a motor 1 having an output drive shaft 2 on which a fan 3 is mounted. A drive pinion on the end of the shaft 2 drives a gear 4 fastened to a stub shaft 5.

The stub shaft 5 also carries a gear 8 which meshes with a gear 9 forming part of a friction clutch 10 carried on a stub shaft 11. On the end of the stub shaft 11, a bevel gear 12 is mounted and this gear 12 meshes with gear teeth 13 formed on the end of an annular gear 14. The gear 14 is coupled by coupling means 40 to a sleeve 15 in which a tool piece (not shown) is coaxially and slidably but non-rotatably mounted by a chuck (not shown). The coupling means 40 can be in the form of mutually engaging dogs formed on respective ones of the gear 14 and the sleeve 15. The dogs transfer rotary motion from the gear 14 to the sleeve 15 while at the same time serve to ensure that axial impacts developed during the hammer operation are not imparted to the gear 14.

At the rear of the tool a handle 18 with a trigger switch 19 controlling the operation of the motor 1 is provided.

When the motor 1 is actuated the tool piece (in this case a drill bit) is rotated via the shaft 2, gear 4, shaft 5, gear 8, gear 9, clutch 10, shaft 11, gear 12, gear 14, and the sleeve 15. The clutch 10 prevents excessive overloading of the motor 1. The fan 3 draws air over the motor 1 preventing overheating of the motor.

In addition to imparting rotary motion to the tool bit the motor 1 also transmits percussive blows to the rear end of the tool bit via a percussion mechanism which will now be described.

The percussion mechanism includes a first member comprising a crank 6 with an eccentric pin 7, the crank being mounted on the end of the stub shaft 5. A second member comprising a cylinder 20 is rotatably connected to the pin 7 and houses a third member comprising a piston 21 slidably mounted in the cylinder.

As will be explained below during operation of the tool the piston 21 is reciprocated relative to the cylinder 20. The cylinder 20 is slidably but non-rotatably mounted in a fourth member 22 which takes the form of a guide tube the rear end of which is open and the front end of which is partly closed by an end wall which includes a spherical portion 23 defining a bearing surface for the guide tube 22 and allowing the guide tube to pivot about a vertical axis.

Figure 2:
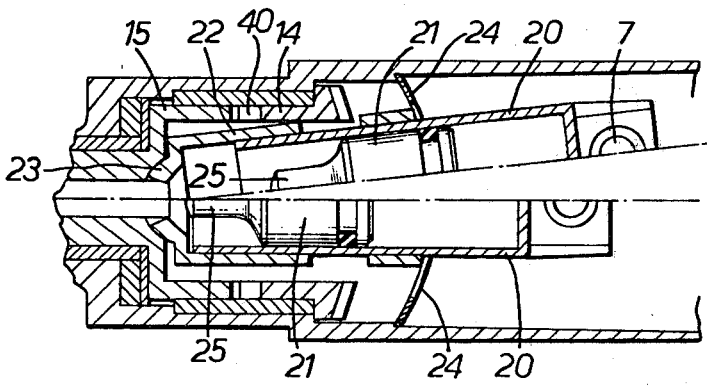
FIG. 2 is a sectional plan view of part of the drill, showing two different positions of the parts.

The rear end of the guide tube 22 bears against a retaining wall 24 which has an elongate transverse slot through which the cylinder 20 passes and which as can be seen in FIG. 2 is curved about the vertical axis of pivoting of the guide tube. Thus the guide tube 22 is free to pivot about a vertical axis but is restrained by the wall 24 from translational movement.

The piston 21 is formed with a ram 25 at its forward end and a beat piece 26 mounted between the tool bit and the ram is sized such that it can pass through a central aperture in the spherical portion 23 of the guide tube. When the tool is being used in its percussive mode, the beat piece 26 transmits blows from the ram 25 to the tool bit.

In FIG. 1, the beat piece 26 is shown in different positions above and below its centreline. In the position shown above the centreline, the beat piece 26 is slidable relative to the sleeve 15 so that when the tool bit is pressed against a workpiece, the tool bit and the beat piece 26 are moved rearwardly and percussive blows are applied by the ram 25 to the beat piece 26 and transmitted by the beat piece to the tool bit. In the position shown below the centre line the beat piece 26 is fixed relative to the sleeve 15 by means not shown. In this fixed position of the beat piece 26, the beat piece is out of the range of reciprocating movement of the ram 25 so that even when the tool bit is pressed against a workpiece percussive blows are not transmitted to the tool bit. The manner in which the position of the beat piece is changed from that shown above its centreline (corresponding to the percussive mode of the tool) to that shown below its centerline (corresponding to the non-percussive mode of the tool) is not an important feature of the present invention and will not be described further.

When the motor 1 is actuated, the crank 6 is rotated via the shaft 2, gear 4 and shaft 5. Rotation of the crank 6 causes the closed rear end of the cylinder 20 to follow a circular horizontal path. Sideways movement of the rear end of the cylinder 20 is accommodated by pivoting of the guide tube 22; the location of the cylinder 20 and the guide tube 22 when the crank pin 7 is at the limit of its sideways movement is shown in the upper portion of FIG. 2 (the lower portion of FIG. 2 shows the location of the parts when the crank pin 7 is in its most forward position as shown in FIG. 1).

Thus, as shown in FIG. 7, the guide tube 22 has a limited lateral oscillatory movement within the housing, which is accommodated by the spherical bearing surface 23 and its complementary spherical seat in the housing; and the cylinder 20 is received within the guide tube for conjoint limited lateral oscillatory motion therewith. Simultaneously, the cylinder 20 is driven by the crank 6 and its eccentric pin 7, and thus the cylinder 20 is reciprocated within the guide tube. An air spring 30 is formed between the piston 21 and the closed rearward end of the cylinder 20, as shown in FIG. 1, thereby causing the piston to reciprocate within the cylinder 20 and relative thereto. The beat piece 26 extends through the spherical bearing surface 23 and its complementary seat in the housing, adjacent to the open forward end of the cylinder 20 as shown in FIG. 1, to engage the ram portion 25 of the piston 21, thereby delivering a series of impact blows to the drill bit or other tool bit carried by the tool.

The central aperature in the spherical portion 23 is sufficiently wide to accommodate the beat piece 26 even when the guide tube 22 is pivoted sideways. Changes in the separation of the crank pin 7 from the spherical portion 23 of the guide tube 22 are accommodated by sliding of the cylinder 20 in the guide tube 22; it can be seen in FIG. 2 that the cylinder 20 is further out of the guide tube 22 in the upper portion of FIG. 2 than in the lower portion of FIG. 2. The backwards and forwards sliding movement of the cylinder causes the piston 21 to reciprocate inside the cylinder, an air cushion 30 which is alternately compressed and expanded being formed between the piston and the closed rear end of the cylinder. Ports (not shown) are provided in the cylinder 20 and the guide tube 22 which mutually coact to adjust the pressure of the air cushion 30 during reciprocation of the piston 21. Such a venting arrangement is described in the copending U.S. patent application, Ser. No. 008,228 filed on Jan. 31, 1979, U.S. Pat. No. 4,290,492 and assigned to the assignee of the present invention.

In the embodiment described the axis of rotation of the crank 6, the axis of pivoting of the guide tube 22 and the longitudinal axis of the tool bit all lie in a common plane. Thus, the piston 21 is directly aligned with the beat piece 26 when the cylinder 20 is in its most forward position; since the movement of the piston lags just slightly behind the movement of the cylinder 20, the ram 25 impacts the beat piece 26 just after the two parts are directly aligned. If it is desired to achieve direct alignment of the ram 25 and the beat piece 26 at the moment of impact then the axis of rotation of the crank 6 must be offset by the appropriate distance from the plane containing the axis of the tool bit and the axis of pivoting of the guide tube 22.

The direct drive of the cylinder 20 from the crank pin 7 enables the percussion mechanism to be very compact but at the same time the interconnection between the crank pin 7 and the cylinder 20 is a simple coupling which has to provide only for relative rotation of the parts.

In the embodiment described, the percussive tool is a rotary percussive drill. The invention may however be applied to other percussive tools, for example a non-rotary percussive drill or a hand-held motor-drive hammer. Furthermore the percussive tool may not be a pneumatic tool; the air cushion between the piston 21 and the cylinder 20 may for example be replaced by a spring.

I claim:

1. A percussive tool including a first member mounted for rotation about a first axis and connected to drive means operative to rotate the first member about the first axis, a second member rotatably connected to the first member at a position spaced from the first axis and arranged to reciprocate a third member, the arrangement being such that during percussive operation of the tool the first member drives the second member which in turn reciprocates the third member and thereby causes blows to be transmitted to a tool piece, wherein the improvement comprises means mounting the second member for pivoting movement about a second stationary axis and for sliding reciprocatory movement towards and away from the second axis, the means including a guide member receiving the second member therein, the guide member being fixed against reciprocation but being free to pivot within the tool, and air spring means between the second and third members for reciprocating movement of the third member relative to the second member.

2. A percussive tool as claimed in claim 1 in which the fourth member comprises a guide tube, and in which the second member is slidably received therein, for simultaneous pivotal movement about the second axis.

3. A percussive tool as claimed in claim 1 or claim 2 in which the first member is a crank and has an eccentric pin on which the second member is rotatably mounted.

4. A percussive tool as claimed in claim 1 in which the second and third members are a cylinder and piston, respectively.

5. A percussive tool as claimed in claim 1, wherein the first and second axes are parallel.

6. A percussive tool as claimed in claim 5, wherein the first and second axes and the longitudinal axis of the tool piece lie in a common plane.

7. A percussive tool as claimed in claim 5, wherein the longitudinal axis of the tool piece is at a slight angle to the plane of the first and second axes.

8. A percussive tool as claimed in claim 1, wherein the tool piece comprises a drill bit, and wherein the tool is a percussive drill and rotary motion is imparted to the drill bit in addition to percussive blows.

9. In a percussive tool having a housing with a motor therein and a tool bit carried by the housing forwardly thereof, the combination of a guide tube and means mounting the guide tube within the housing for limited lateral oscillatory movement therein, a cylinder within the guide tube and having a conjoint limited lateral oscillatory movement therewith, crank means between the motor and the cylinder for simultaneously reciprocating the cylinder within the guide tube, a piston within the cylinder, means for reciprocating the piston relative to the cylinder, and means responsive to the reciprocation of the piston within the cylinder for delivering impact blows to the tool bit.

10. In a percussive tool having a housing with a motor therein and a tool bit carried by the housing forwardly thereof, the combination of a cylinder and means mounting the cylinder within the housing for limited lateral oscillatory movement therein, crank means between the motor and the cylinder for simultaneous reciprocating the cylinder within the housing, a piston within the cylinder, the cylinder having a closed end wall, air spring means between the piston and the closed end wall of the cylinder for reciprocating the piston within the cylinder and relative thereto, and means responsive to the relative reciprocation of the piston within the cylinder for delivering impact blows to the tool bit.

11. In a percussive tool having a housing with a motor therein and a tool bit carried by the housing forwardly thereof, the combination of a guide tube and means mounting the guide tube within the housing for limited lateral oscillatory movement therein, a cylinder within the guide tube and having a conjoint limited lateral oscillatory movement therewith, crank means between the motor and the cylinder for simultaneously reciprocating the cylinder within the guide tube, a piston within the cylinder, the cylinder having a closed end wall adjacent to the crank means, air spring means between the piston and the closed end of the cylinder for reciprocating the piston within the cylinder and relative thereto, and means responsive to the reciprocation of the piston within the cylinder for delivering impact blows to the tool bit.

12. The combination of claim 11, wherein the means mounting the guide tube within the housing includes a spherical bearing surface pivoting about a complementary seat formed in the housing.

13. The combination of claim 12, wherein the end of the cylinder opposite to the closed end of the cylinder, and adjacent to the spherical bearing surface, is open; and wherein the piston has a ram extending forwardly of the open end of the cylinder.

14. The combination of claim 13, further including a beat piece between the tool bit and the ram on the piston, the beat piece extending through an opening in the spherical bearing surface on the guide tube and its complementary seat in the housing.

15. In a percussive tool having a housing with a motor therein and a tool bit carried by the housing forwardly thereof, the combination of a guide tube and means mounting the guide tube within the housing for limited lateral oscillatory movement therein, said means including a spherical bearing surface formed on the forward portion of the guide tube and a complementary spherical seat formed in the housing, a cylinder within the guide tube and having a conjoint limited oscillatory movement therewith, the cylinder having an open forward end and a closed rearward end, crank means between the motor and the closed end of the cylinder for simultaneously reciprocating the cylinder within the guide tube, a piston within the cylinder, means including an air spring between the piston and the closed end of the cylinder for reciprocating the piston within the cylinder and relative thereto, the piston having a ram forwardly thereof, and a beat piece extending through the spherical bearing surface and its complementary seat, adjacent to the open end of the cylinder, to receive a series of impact blows from the ram on the piston.

* * * * *